US005178209A

United States Patent [19]

Aoki et al.

[11] Patent Number: 5,178,209

[45] Date of Patent: Jan. 12, 1993

[54] CONDENSER FOR AUTOMOTIVE AIR CONDITIONING SYSTEMS

[75] Inventors: Hisao Aoki, Maebashi; Toru Yamaguchi, Isesaki, both of Japan

[73] Assignee: Sanden Corporation, Gunma, Japan

[21] Appl. No.: 696,328

[22] Filed: Apr. 30, 1991

Related U.S. Application Data

[63] Continuation of Ser. No. 378,630, Jul. 12, 1989, abandoned.

[30] Foreign Application Priority Data

Jul. 12, 1988 [JP] Japan ..... 63-91397[U]

[51] Int. Cl.[5] ..... F28B 9/08

[52] U.S. Cl. ..... 165/110; 165/153; 165/173; 165/174

[58] Field of Search ..... 165/110, 153, 173, 174

[56] References Cited

U.S. PATENT DOCUMENTS

| | | | |
|---|---|---|---|
| 1,795,878 | 3/1931 | Mougey . | |
| 2,068,549 | 1/1937 | Knight . | |
| 2,200,788 | 5/1940 | Coy . | |
| 2,612,349 | 9/1952 | Lintern | 165/110 X |
| 3,063,682 | 11/1962 | Greene et al. | 165/110 |
| 3,835,920 | 9/1974 | Mondt . | |
| 4,336,837 | 6/1982 | Koenig . | |
| 4,467,862 | 8/1984 | DeBeni . | |
| 4,515,209 | 5/1985 | Maidanik et al. . | |
| 4,825,941 | 5/1989 | Hoshino et al. | 165/110 |
| 4,829,780 | 5/1989 | Hughes et al. . | |
| 4,977,956 | 12/1990 | Aoki et al. . | |

FOREIGN PATENT DOCUMENTS

| | | | |
|---|---|---|---|
| 188319 | 1/1957 | Austria . | |
| 1265756 | 5/1961 | France . | |
| 63-112065 | 5/1988 | Japan . | |
| 63-113300 | 5/1988 | Japan . | |
| 2-13953 | 1/1990 | Japan . | |
| 160689 | 10/1957 | Sweden | 165/174 |
| 143822 | 5/1920 | United Kingdom | 165/110 |

*Primary Examiner*—Allen J. Flanigan
*Attorney, Agent, or Firm*—Baker & Botts

[57] ABSTRACT

A condenser, for use in automotive air conditioning systems, including a first header, a second header, a plurality of parallel flat plate pipes arranged between the first and second headers, and corrugated fins between the flat plate pipes for contacting the flat surfaces thereof. A second union joint on the second header introduces refrigerant into the second header. A first union joint on the first header discharges refrigerant to a refrigeration circuit. The first union joint includes a union portion for connecting the first union joint with the refrigeration circuit, a fixed portion with a receiving surface which is fitted on the outer peripheral surface of the first header, and a pipe which is connected to the union portion. The pipe extends downwardly within the first header to the bottom of the first header, and thus, the first union joint discharging liquid refrigerant can be disposed anywhere on the first header.

31 Claims, 4 Drawing Sheets

CONDENSER FOR AUTOMOTIVE AIR CONDITIONING SYSTEMS

This application is a continuation of application Ser. No. 07/378,630, filed Jul. 12, 1989 now abandoned.

TECHNICAL FIELD

The present invention relates to condensers, and more particularly, to condensers for use in automotive air conditioning systems.

BACKGROUND OF THE INVENTION

A parallel flow type condenser as shown in FIG. 1 is well known as a condenser which has a higher heat exchanging efficiency than a serpentine type condenser as shown in FIG. 2. The parallel flow type condenser includes a pair of first and second headers 1 and 2, a plurality of flat plate pipes 3 whose inner space is divided into a plurality of small passages by a plurality of vertical partition walls and corrugated fins 4 which are disposed between flat plate pipes 3. Both ends of flat plate pipes 3 are inserted into horizontal holes (not shown) which are formed at opposing positions on the outer peripheral surface of first and second headers 1 and 2, respectively, and connect between both headers 1 and 2 to communicate therebetween. Union joints 5 and 6 connecting the condenser with a refrigeration circuit are formed on one end of first and second headers 1 and 2, respectively.

Since the parallel flow type condenser has no serpentine portions 7 on a flat plate pipe as shown in FIG. 2, space 1 between flat plate pipes 3 are shown in FIG. 1, can be designed to be smaller than that in FIG. 2. That is, refrigerant flows through a plurality of flat plate pipes 3 which are arranged parallel to each other, thereby significantly reducing refrigerant pressure loss in the condenser. As a result, the diameter of flat plate pipes 3 can be minimized, and refrigerant can be efficiently condensed. Further, more flat plate pipes 3 can be used without enlarging the size of the condenser. Thus, the radiating area of the condenser can be increased, and its heat exchanging efficiency improved.

In the above-mentioned condenser, gaseous or vapor refrigerant flowing into second header 2 through union join 5 is condensed and exchanged into liquid refrigerant by passing through flat plate pipes 3. The liquid refrigerant which is passed through first header 1 is discharged through union joint 6, which is formed at the lowest end of first header 1, to a refrigeration circuit.

Since liquid refrigerant flows downwardly along the inner peripheral surface of first header 1, if union join 8 is disposed above the lowest end of first header 1 as shown in FIG. 3, liquid refrigerant flowing from flat plate pipes 3 positioned below union joint 8 accumulates at the inside bottom of first header 1, by way of flat plate pipes 31, thereby creating a non-heat exchanging portion in the condenser. Thus, it is necessary to dispose a union joint to discharge liquid refrigerant at the lowest end of the header, thereby limiting the design when the condenser is to be disposed in a limited space, such as in a car.

SUMMARY OF THE INVENTION

It is thus a primary object of the present invention to provide a condenser whose union joint for discharging liquid refrigerant can be disposed anywhere on the header.

It is another object of the present invention to provide a condenser which can positively discharge liquid refrigerant to a refrigeration circuit to maintain heat exchanging efficiency.

A condenser for use in an automotive air conditioning system according to the present invention includes a first header, a second header, and a plurality of parallel flat plate pipes between the first and second headers. Corrugated fins between the flat plate pipes contact the flat surfaces thereof. A second union joint on the second header introduces refrigerant into the second header, and the first union joint on the first header discharges refrigerant to a refrigeration circuit. The first union joint comprises a union portion for connection with the refrigeration circuit, a fixed portion having a receiving surface lifted on the outer peripheral surface of the first header, and an extending pipe connected to the union portion and extending downwardly within the first header to a position adjacent the bottom of the first header.

Other objects, features and aspects of this invention will be understood from the following detailed description of preferred embodiments of this invention and by referring to the attached drawings.

BRIEF DESCRIPTION OF THE DRAWINGS

FIG. 4(*b*) is a top view of the union joint of the condenser of FIG. 4(*a*).

FIG. 4(*c*) is a cross-sectional view of the union joint taken along line A—A in FIG. 4(*b*).

FIG. 5(*b*) is a cross-sectional view of the union joint as shown in FIG. 5(*a*).

DETAILED DESCRIPTION OF PREFERRED EMBODIMENTS OF THE INVENTION

Figure 2:
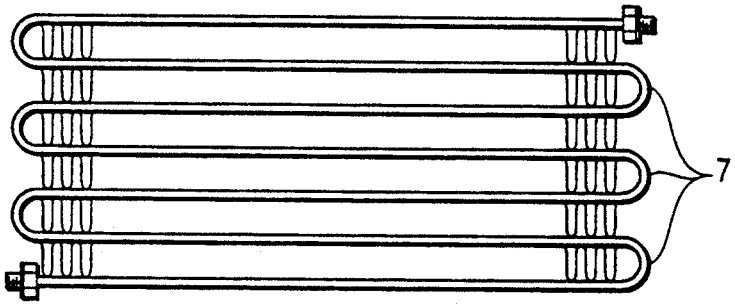
FIG. 2 PRIOR ART
FIG. 2 is a front view of another conventional condenser.
Figure 1:
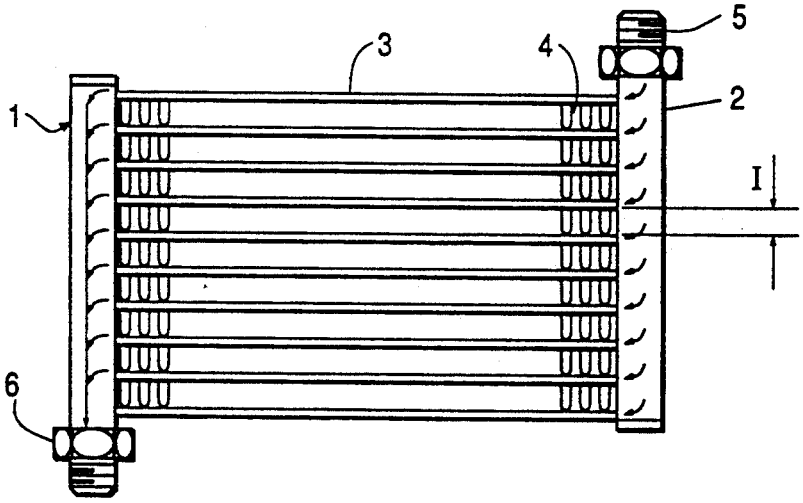
FIG. 1 PRIOR ART
FIG. 1 is a front view of a conventional condenser.
Figure 3:
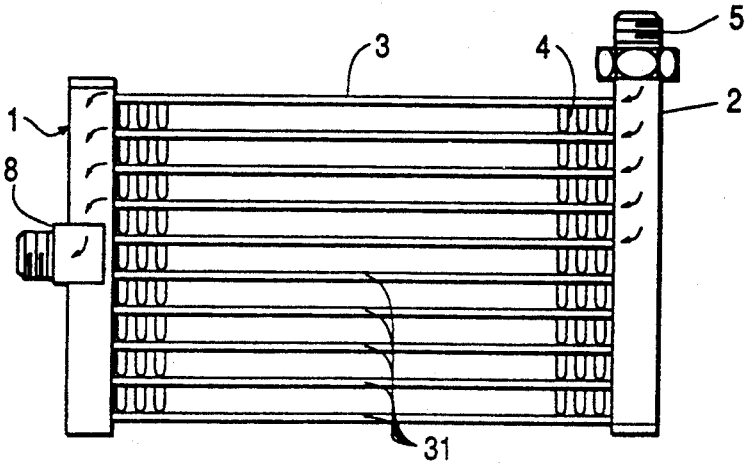
FIG. 3 PRIOR ART
FIG. 3 is a front view of a further conventional condenser.
Figure 4A:
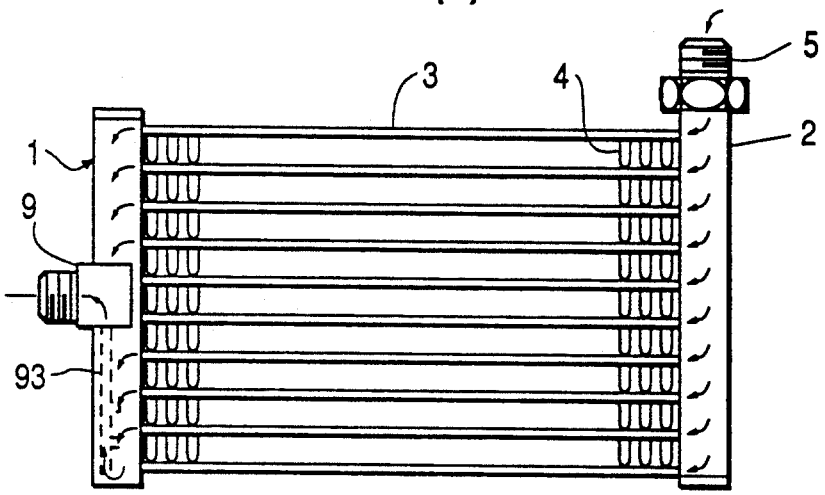
FIG. 4(*a*) is a front view of a condenser in accordance with one embodiment of the present invention.
Figure 4B:
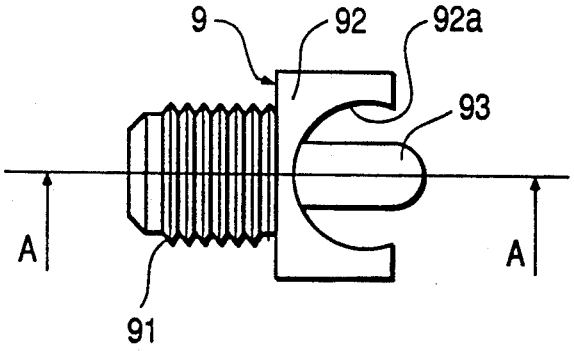
Figure 4C:
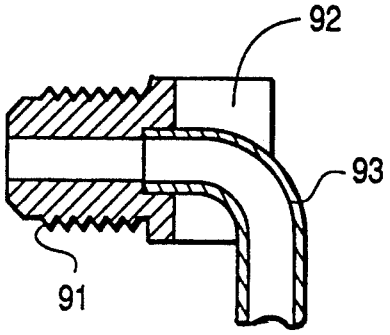

Referring to the drawings, FIGS. 4(*a*)–4(*c*) illustrate a condenser according to one embodiment of the present invention. As shown in FIG. 4(*a*), the condenser has a first header 1, a second header 2 and a plurality of parallel flat plate pipes 3 between first and second headers 1 and 2. Corrugated fins 4 between flat plate pipes 3 contact their flat surfaces. Second union joint 5 formed on the upper end of second header 2 introduces refrigerant vapor into the condenser. As shown in FIGS. 4(*b*)–(*c*), first union joint 9 discharges liquid refrigerant to a refrigeration circuit, which is positioned at the middle of first header 1, and includes union portion 91, fixing portion 92 and extending pipe 93, and wherein union portion 91 and fixing portion 92 are integrally formed. First union joint 9 is fixed on the outer peripheral surface of first header 1 through fixing portion 92 which has a receiving portion 92*a* fitted on the outer peripheral surface thereof. Extending pipe 93 which is connected to union portion 91 at one end thereof extends downwardly within first header 1 to a position adjacent the bottom of the first header.

The refrigerant vapor introduced into the interior of second header 2 passes through a plurality of flat plate pipes 3 and is heat exchanged during passage therethrough by air flowing through corrugated fins 4. Accordingly, refrigerant vapor changes into liquid refrigerant, which then flows downwardly from the end of flat plate pipes 3 along the inner peripheral surfaces of first header 1. Once the liquid refrigerant reaches the bottom end portion of first header 1, it is sucked up from the end of extending pipe 93 and discharged to the refrigeration circuit through union portion 91. That is, even though the union joint (9) for discharging liquid refrigerant is positioned at the middle of first header 1, the liquid refrigerant can be positively discharged from the bottom thereof to the refrigeration circuit.

Figure 5A:
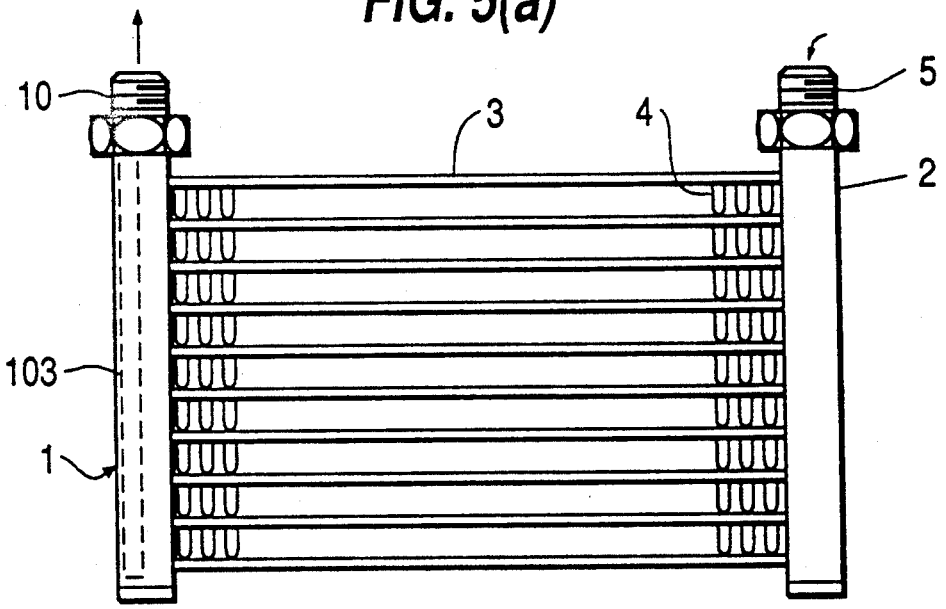
FIG. 5(*a*) is a front view of a condenser in accordance with a further embodiment of the present invention.
Figure 5B:
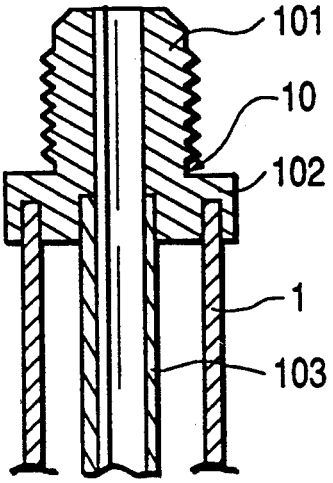

FIGS. 5(*a*)–(*c*) illustrate a condenser in accordance with a further embodiment of the present invention. Union joint 10 for discharging liquid refrigerant in this embodiment is provided on the upper end of the first header 1. Union joint 10 is constructed of union portion 101, fixing portion 102 and extending pipe 103, wherein union portion 101 and fixing portion 102 are integrally formed. Extending pipe 103 is connected to union portion 101 at one end thereof and extends downwardly within first header 1 to a position adjacent the bottom of the first header. The refrigerant vapor flows within the condenser and condenses to a liquid. The liquid refrigerant is then discharged to a refrigeration circuit as described in the above embodiment.

Figure 6:
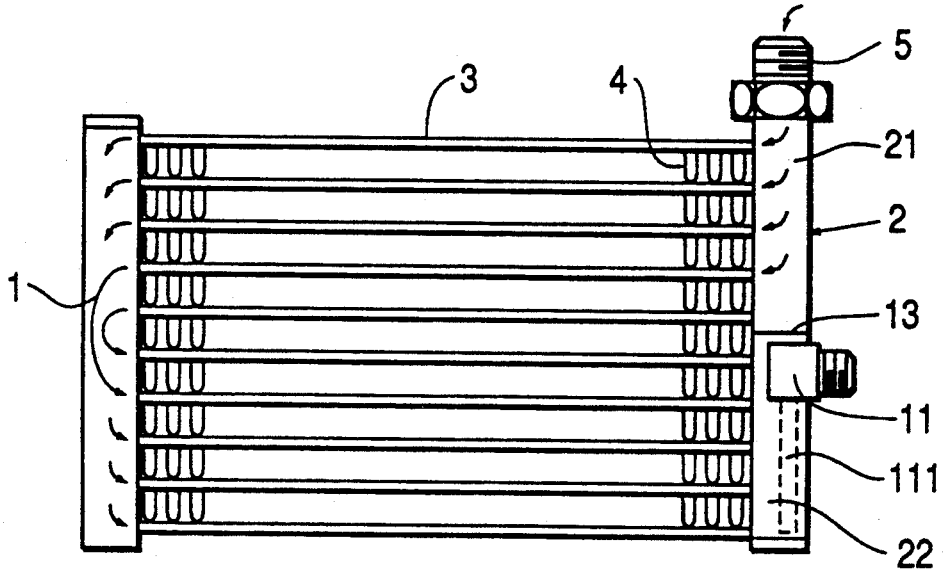
FIG. 6 is a front view of a condenser in accordance with a still further embodiment of the present invention.

FIG. 6 illustrates a condenser in accordance with a further embodiment of the present invention. This condenser has a first header 1, a second header 2 which is divided to two chambers, namely, a first chamber 21 and a second chamber 22, by inner partition wall 13, and a plurality of parallel flat pipes 3 arranged between first and second headers 1 and 2. Corrugated fins 4 between flat plate pipes 3 contact with the flat surfaces thereof. A second union joint 5 is formed on the upper end of second header 2 for introducing refrigerant vapor into first chamber 21 of second header 2. First union joint 11 at the middle of second header 2 communicates with second chamber 22 thereof. Since the construction and operation of union joint 11 are the same as that of the first embodiment of this invention, further description thereof is not herein provided.

This invention has been described in detail in connection with the preferred embodiments, but is for example only and this invention is not restricted thereto. It will be easily understood by those skilled in the art that other variations and modifications can be easily made within the scope of this invention.

What is claimed is:

1. An air conditioning system condenser, comprising:

a condenser first header having an outer peripheral surface;

a condenser second header;

a plurality of parallel flat plate pipes positioned between said first and second headers, said flat plate pipes having flat surfaces;

corrugated fins positioned between said flat plate pipes and contacting said flat surfaces; and first union joint means on said first header for discharging refrigerant in said first header to a condenser refrigeration circuit, said first union joint means comprising a union portion for connection with the condenser refrigeration circuit, a fixed portion having a receiving surface fitted on said outer peripheral surface, and a liquid-refrigerant extended discharge outlet pipe connected to said union portion, said extended discharge outlet pipe extending downwardly within said first header to a position adjacent an inside bottom of said first header.

2. The condenser of claim 1 wherein said union portion and said fixed portion are integrally formed.

3. The condenser of claim 1 wherein said first header has a top, and said first union joint means is positioned at said top of said first header.

4. The condenser of claim 1 wherein said first union joint means is positioned at a central location of said first header.

5. The condenser of claim 1 further comprising a second union joint means on said second header for introducing refrigerant vapor into said second header.

6. The condenser of claim 1 wherein said first header is divided into first and second chambers and said first union joint means communicates with said second chamber.

7. The condenser of claim 6 further comprising a second union joint means for introducing vapor refrigerant into said first chamber.

8. An air conditioning system condenser, comprising:

a condenser first header having an inside bottom;

a condenser second header;

a plurality of parallel pipes positioned between and defining passageways in fluid communication with said first and second headers, said pipes being arranged to define at least one air path therebetween;

corrugated fins positioned between said pipes and in said air path;

fitting means on said first header and spaced a distance above said inside bottom for discharging liquid refrigerant from said first header;

introducing means for introducing vapor refrigerant into at least one of said first and second headers; and pipe means for positively discharging liquid refrigerant from said inside bottom and out said fitting means.

9. The condenser of claim 8 wherein said fitting means is positioned at a top of said first header.

10. The condenser of claim 8 wherein said fitting means is positioned at a central location of said first header.

11. The condenser of claim 8 wherein said pipes extend at right angles to said first header and to said second header.

12. The condenser of claim 8 wherein said introducing means includes a fitting positioned on said second header.

13. The condenser of claim 8 wherein said introducing means includes a fitting positioned on said first header.

14. The condenser of claim 13 wherein said fitting is positioned spaced above said fitting means.

15. The condenser of claim 13 wherein said first header is divided into first and second chambers, said fitting means communicates with said first chamber and said fitting communicates with said second chamber.

16. The condenser of claim 8 wherein said fitting means comprises a union portion connectable with a refrigerant circuit and a fixed portion connected to said pipe means.

17. The condenser of claim 16 wherein said first header has an outer peripheral surface and said fixed portion has a receiving surface mounted on said outer peripheral surface.

18. The condenser of claim 16 wherein said union portion and said fixed portion are integrally formed.

19. The condenser of claim 16 wherein said pipe means comprises a pipe extending downwardly within said first header from said fixed portion to a position adjacent said inside bottom.

20. The condenser of claim 8 wherein said pipes comprise flat plate pipes.

21. The condenser of claim 20 wherein said flat plate pipes have flat surfaces and said corrugated fins contact said flat surfaces.

22. The condenser of claim 8 wherein said pipe means comprises a pipe extending downwardly within said first header from said fitting means to a position adjacent said inside bottom.

23. The condenser of claim 1 wherein said first and second headers are disposed upright.

24. The condenser of claim 1 further comprising introducing means for introducing vapor refrigerant into said first header.

25. The condenser of claim 1 further comprising introducing means for introducing vapor refrigerant into said second header.

26. The condenser of claim 5 wherein said second union joint means introduces refrigerant vapor from the refrigeration circuit into said second header.

27. The condenser of claim 8 wherein said fitting means discharges the liquid refrigerant into a refrigeration circuit, and said introducing means introduces vapor refrigerant flowing from the refrigeration circuit.

28. The condenser of claim 8 wherein said first and second headers are both vertically disposed.

29. A condenser for use in an automotive air conditioning system, said condenser comprising:

a first header, said first header having an outer peripheral surface, and said first header being divided into first and second chambers;

a second header;

a plurality of parallel flat plate pipes positioned between said first and second headers, said flat plate pipers having flat surfaces;

corrugated fins positioned between said flat plate pipes for contacting said flat surfaces; and a union joint on said first header discharging refrigerant to a refrigeration circuit, said union joint communication with said second chamber, said union joint comprising a union portion for connection with the refrigeration circuit, a fixed portion having a receiving surface fitted on said outer peripheral surface, and an extended pipe connected to said union portion, said extended pipe extending downwardly within said first header to a position adjacent an inside bottom of said first header.

30. The condenser of claim 29 wherein said union joint defines a first union joint, and further comprising a second union joint for introducing vapor refrigerant into said first chamber.

31. The condenser of claim 8 wherein said introducing means introduces the vapor refrigerant from a refrigeration circuit and said fitting means discharges the liquid refrigerant to that refrigeration circuit.

* * * * *